United States Patent [19]

McCann et al.

[11] Patent Number: 4,576,517

[45] Date of Patent: Mar. 18, 1986

[54] MARINE HEAVE COMPENSATING DEVICE

[75] Inventors: James McCann, West Lothian; James Langley, Midlothian; Ian Hopper; Steven Durham, both of Edinburgh; Thomas Scott, E. Lothian; Eric R. McOmish, Edinburgh, all of Scotland

[73] Assignee: 501 Vickers PLC, London, England

[21] Appl. No.: 663,055

[22] Filed: Oct. 19, 1984

[30] Foreign Application Priority Data

Oct. 21, 1983 [GB] United Kingdom ..... 8328147

[51] Int. Cl.[4] ..... B63B 35/44

[52] U.S. Cl. ..... 405/195; 166/359; 175/7; 114/264

[58] Field of Search ..... 405/195, 203–208, 405/224; 114/264, 265; 175/5, 7; 166/350, 359, 367

[56] References Cited

U.S. PATENT DOCUMENTS

| | | | |
|---|---|---|---|
| 3,760,875 | 9/1973 | Busking | 166/359 X |
| 3,939,991 | 2/1976 | Person | 114/265 X |
| 3,943,868 | 3/1976 | Person et al. | 114/264 |
| 4,200,054 | 4/1980 | Elliston | 114/264 |
| 4,351,261 | 9/1982 | Shanks | 114/264 |
| 4,379,657 | 4/1983 | Widiner et al. | 405/195 |
| 4,487,150 | 12/1984 | Shanks | 175/5 X |

*Primary Examiner*—Dennis L. Taylor

*Attorney, Agent, or Firm*—Leydig, Voit & Mayer Ltd.

[57] ABSTRACT

A marine heave compensating device comprises a hydraulic piston and cylinder unit (15,16) with its cylinder (15) secured to a support (10,11). The piston is connected via a piston rod (16) to a cross-head (17) on which a first set of pulleys (18) are rotatably mounted. Chains (19) secured at one end to the support (10,11) are entrained around pulleys (18) and support a yoke (20) on which is mounted a crown block (21). A cable (22) is reeved around crown block (21) and around a travelling block (23) which carries a tool carrier (24). The two ends of cable (22) are reeved around two second pulleys (26A,26B) rotatably mounted on the cross-head (17). End (22A) of cable (22) is connected to a draw-works and end (22B) of cable (22) is connected to a tie-down.

4 Claims, 1 Drawing Figure

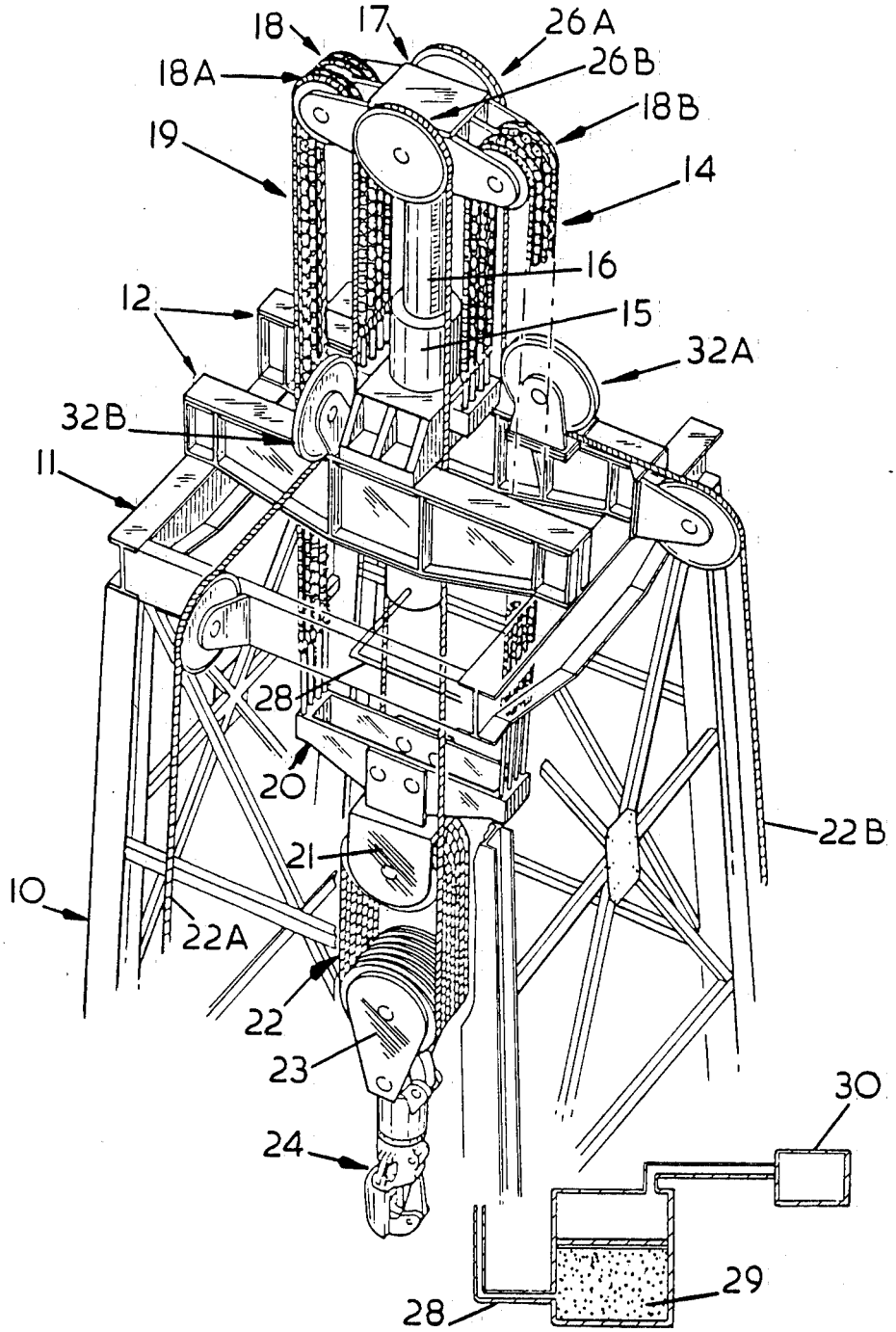
18
17
26A
18A
26B
18B
19
14
16
12
15
32A
32B
11
28
20
22B
21
10
22A
22
23
30
24
29
28

MARINE HEAVE COMPENSATING DEVICE

This invention relates to marine heave compensating devices.

For performing certain operations on a sea bed by means of a rigid work tool extending from a tool carrier mounted on a floating drill ship or drill rig it is known that the tool carrier requires to be stabilised in position to negate the effects of marine heave on the rigid tool. The tool may conveniently be in the form of a drill string extending within a derrick mounted on the drill ship in which case the tool carrier forms part of a suspension system carried by a platform at or near the top of the derrick and referred to in the art as a water table. The suspension system usually comprises a travelling block secured to the tool carrier and a crown block around which is reeved a wire rope or hawser one end of which is anchored to the floating platform, the other end being connected to a draw works (i.e. a main winch). The purpose of the suspension system is to permit movement of the travelling block towards the sea bed as the drill string and its cutting tool penetrates the sea bed.

Various forms of marine heave compensators are known for the purpose of stabilising the tool carrier against marine heave movements but the known compensators are mechanically complex and usually incorporate a hydraulic piston and cylinder unit which moves for the purpose of achieving the compensation effect so that it is necessary to provide flexible conduits for supply of the hydraulic fluid to these units. Such flexible conduits are a well known source of trouble in that they are easily fractured and furthermore a significant space volume requires to be provided which is free from obstruction to permit passage of the flexible conduit throughout its various movements. In a prior proposal to provide an improved compensating device of simplified mechanical structure only the tool carrier has been compensated and as a result the suspension system and the crown and travelling blocks have had to undertake an additional role to provide part of the required compensatory movements in addition to its normal tool movement function.

It is an object of the present invention to provide an improved form of marine heave compensating device.

According to the present invention a marine heave compensating device comprises a support structure, a hydraulic piston and cylinder unit of which the cylinder is fixedly mounted on the support structure, the piston being connected to a piston rod carrying a cross-head, first pulley means rotatably mounted on the cross-head, a yoke suspended by one or more substantially inextensible flexible members secured at one end to the yoke and passing around said first pulley means, the other end or ends of said flexible members being secured to said support structure, and a suspension system comprising a crown block mounted on the yoke, a cable reeved around the crown block and around a travelling block on which is mounted a tool carrier, the two ends of said cable being respectively reeved around two second pulley means rotatably mounted on said cross-head, one end of the cable thereafter being connected to a draw-works and the other end of the cable thereafter being connected to a tie-down on said support structure, the number of pulley wheels in said first pulley means being the same as the number of pulley wheels in said second pulley means.

In one embodiment the first pulley means comprises a single pulley wheel around which the inextensible flexible members are reeved and each said second pulley means also comprises one pulley wheel around which respective ends of the cable are reeved. It will however be appreciated that the first pulley means could comprise two pulley wheels mounted on the crosshead in which case the inextensible flexible members would be reeved around these two pulley wheels and around an intervening pulley wheel fixedly secured to the support structure. Likewise in this arrangement each end of the cable would be reeved around two pulley wheels mounted on the crosshead and an intervening pulley wheel fixedly mounted on the support structure.

It will also be appreciated that although only one inextensible flexible member is required in principle, for the purposes of load bearing it may be desirable to have a plurality of inextensible members such as chains mounted in parallel with each other.

An embodiment of the present invention will now be described by way of example with reference to the accompanying drawing which illustrates a marine heave compensating device mounted at the top of a derrick which is carried by a floating drill ship or the like.

As is shown in the drawing a rigid support structure in the form of a derrick 10 is provided at its upper end with a platform 11 or water table incorporating a pair of spaced parallel beams 12 which support a marine heave compensating device 14. Device 14 comprises a cylinder 15 fixedly mounted on beams 12 in a vertical orientation and from the upper end of the cylinder 15 emerges a piston rod 16 carrying a crosshead 17 on which a plurality of live pulley wheels are rotatably mounted for a purpose to be explained. These pulley wheels comprise a first pulley means 18 around which are reeved chains 19 which at one end are secured to the support platform 11 whilst at the other end are secured to a yoke 20. For the purposes of mechanical balance and stability pulley means 18 is in fact formed in two halves so that half the chains 19 are reeved around means 18A whilst the other half of the chains 19 are reeved around means 18B. In this way both ends of the yoke 20 are carried by chains 19.

Within fixed cylinder 15 piston rod 16 is secured to an apertured piston and both sides of the piston are filled with hydraulic fluid, the lower end of the cylinder 15 being coupled by a rigidly plumbed conduit 28 (illustrated schematically) to a hydro-pneumatic accumulator 29 to which a source of compressed air 30 is connected. It will therefore be seen that compensating device 14 is free from flexible hoses.

Yoke 20 carries a multiple purchase crown block 21 which is connected by means of cable 22 to a travelling block 23 on which a tool carrier 24 is mounted. Cable 22 is reeved around the various pulley wheels of blocks 21 and 23 and the two free cable ends are directed upwardly through the platform 11 to pass around respective pulley wheels 26A, 26B rotatably mounted on cross-head 17 whereafter one cable end 22A is guided towards a draw works (not shown) whilst the other cable end 22B is guided towards an anchorage or tie down (not shown). It will therefore be appreciated that in the absence of heave motion on the platform 11 cable end 22A can be paid out to permit travelling block 23 to move away from crown block 21 with a mechanical advantage appropriate to the number of pulley wheels in these blocks so that the tool carrier 24 will move vertically downwardly (i.e. towards the sea bed). This action usually occurs at a rate which is insignificant in relation to the rate of movement of platform 11 arising from the effect of heave and sea swell and accordingly compensation for the heave movements is effected on the assumption that both blocks 21 and 23 are stationary. This is achieved by virtue of pulley wheels 26A and 26B being mounted on crosshead 17 in common with the pulley means 18, the arrangement being such that as crosshead 17 moves up and down relative to platform 11 under its compensatory action yoke 20 remains substantially stationary in space and the pulley wheels of blocks 21 and 23 remain stationary also, because cable length variation is effected by the two cable loops passing around pulleys 26A, 26B.

Various advantages arise from the embodiment described above. For example, in a conventional drill rig derrick 10 both the crown block 21 and the travelling block 23 are laterally guided by guide rails (not shown). Because compensating device 14 is mounted above the platform 11 no modification of these guide rails is required. Also if compensating device 14 requires to be disabled for maintenance or repair purposes but operation of the tool is to be maintained, it is a simple matter to raise yoke 20 to the level of platform 11 and to bolt or otherwise temporarily secure the yoke 20 to beams 12. In this case it will be evident that the ends of cable 22 extending around pulley wheels 26A, 26B require to be temporarily reeved in a different configuration so as to avoid use of these pulley wheels but this is easily achieved in the illustrated embodiment by reverse reeving around guide wheels 32A, 32B.

It will be observed that in the embodiment chains 19 are arranged in two sets of four and because it is commonplace for individual chains to wear, and therefore to stretch at different rates throughout their working lives it is desirable to incorporate a tension equalising device at one end of these chains. Preferably a tension equalising device is provided at the end of chains 19 secured to the support structure formed by beams 12. The convenient tension equalising device is in the form of hydraulically interconnected hydraulic cylinders incorporating piston rods secured to the respective chain ends.

It will also be observed that because chains 19 are reeved over pulley means 18 carried by crosshead 17, the extent of piston rod travel is only half that of the yoke 20 which consequentially reduces the overall size of the device 14.

Although reference has been made to chains 19 and cable 22 it will be appreciated that these components may take any convenient form for achieving the desired purpose.

As has been explained, in order to achieve the heave compensation movement without unwanted movement of the crown block and travelling block, the present invention provides that the chain 19 is reeved around the same number of live pulley wheels as is each end of cable 22, these live pulley wheels being carried by crosshead 17. Of course, if chain 19 is reeved over N number of live pulley wheels it will also require to be reeved around (N−1) number of dead or stationary pulley wheels secured to platform 11 and each end of cable 22 will also require to be reeved around N number of live pulley wheels and (N−1) number of dead or stationary pulley wheels mounted on platform 11. In this general case, the extent of piston rod travel will be ½N the travel of yoke 20 which will facilitate a general reduction in size of device 14. It will be appreciated that a plurality of cylinders 15 could be mounted in parallel on beams 12 with each piston rod 16 connected to the cross-head 17 for the purpose of increasing thrust.

What is claimed is:

1. A marine heave compensating device comprising a support structure, a hydraulic piston and cylinder unit of which the cylinder is fixedly mounted on the support structure, the piston being connected to a piston rod carrying a cross-head, first pulley means rotatably mounted on the cross-head, a yoke suspended by one or more substantially inextensible flexible members secured at one end to the yoke and passing around said first pulley means, the other end or ends of said flexible members being secured to said support structure, and a suspension system comprising a crown block mounted on the yoke, a cable reeved around the crown block and around a travelling block on which is mounted a tool carrier, the two ends of said cable being respectively reeved around two second pulley means rotatably mounted on said cross-head, one end of the cable thereafter being connected to a draw-works and the other end of the cable thereafter being connected to a tie-down on said support structure, the number of pulley wheels in said first pulley means being the same as the number of pulley wheels in said second pulley means.

2. A device as claimed in claim 1, wherein said flexible members are in the form of chains incorporating tension equalising means at one end thereof.

3. A device as claimed in claim 1, wherein each of said flexible members and the two ends of said cable are reeved around N number of live pulley wheels rotatably mounted on said cross-head, and also around (N−1) number of dead pulley wheels on said support structure.

4. A device as claimed in claim 1, wherein said piston and cylinder unit is rigidly coupled to a hydro-pneumatic accumulator to which a source of pressurised air is connected.

* * * * *